US011377619B2

(12) United States Patent
Nara et al.

(10) Patent No.: US 11,377,619 B2
(45) Date of Patent: Jul. 5, 2022

(54) REFRIGERATING MACHINE OIL

(71) Applicant: ENEOS Corporation, Tokyo (JP)

(72) Inventors: Fumiyuki Nara, Tokyo (JP); Yohei Shono, Tokyo (JP); Takeshi Okido, Tokyo (JP); Hidetoshi Ogata, Tokyo (JP)

(73) Assignee: ENEOS CORPORATION, Tokyo (JP)

( * ) Notice: Subject to any disclaimer, the term of this patent is extended or adjusted under 35 U.S.C. 154(b) by 210 days.

(21) Appl. No.: 16/479,706

(22) PCT Filed: Jan. 30, 2018

(86) PCT No.: PCT/JP2018/003013
§ 371 (c)(1),
(2) Date: Jul. 22, 2019

(87) PCT Pub. No.: WO2018/143212
PCT Pub. Date: Aug. 9, 2018

(65) Prior Publication Data

US 2021/0230501 A1 Jul. 29, 2021

(30) Foreign Application Priority Data

Feb. 3, 2017 (JP) ..... JP2017-018728
Oct. 17, 2017 (JP) ..... JP2017-201118

(51) Int. Cl.

| | |
|---|---|
| ***C10M 171/00*** | (2006.01) |
| ***C10M 171/02*** | (2006.01) |
| *C10N 20/00* | (2006.01) |
| *C10N 20/02* | (2006.01) |
| *C10N 30/06* | (2006.01) |
| *C10N 40/30* | (2006.01) |

(52) U.S. Cl.
CPC ..... *C10M 171/008* (2013.01); *C10M 171/02* (2013.01); *C10M 2203/003* (2013.01); *C10M 2223/041* (2013.01); *C10N 2020/015* (2020.05); *C10N 2020/02* (2013.01); *C10N 2030/06* (2013.01); *C10N 2040/30* (2013.01)

(58) Field of Classification Search
CPC ..... C10M 171/008; C10M 171/02; C10M 2223/041; C10M 2203/003; C10N 2020/02; C10N 2040/30; C10N 2030/06; C10N 2020/015
See application file for complete search history.

(56) References Cited

U.S. PATENT DOCUMENTS

| | | | | |
|---|---|---|---|---|
| 10,647,937 | B2 * | 5/2020 | Kuroda | C10M 101/02 |
| 2006/0172898 | A1 * | 8/2006 | Roby | C10M 111/04 508/485 |
| 2010/0093568 | A1 | 4/2010 | Tagawa et al. | |
| 2010/0105585 | A1 * | 4/2010 | Carey | C10M 141/10 508/162 |
| 2017/0009144 | A1 * | 1/2017 | Aalto | C09D 7/20 |

FOREIGN PATENT DOCUMENTS

| | | | |
|---|---|---|---|
| CN | 1696260 | | 11/2005 |
| CN | 101275099 | | 10/2008 |
| CN | 104194899 | | 12/2014 |
| CN | 104379710 | | 2/2015 |
| EP | 0989179 | | 3/2000 |
| EP | 2821466 | A1 | 1/2015 |
| EP | 2963098 | A1 | 1/2016 |
| JP | 58-93796 | | 6/1983 |
| JP | 2005-325151 | | 11/2005 |
| JP | 2008-013677 | | 1/2008 |
| JP | 2016-074785 | | 5/2016 |
| KR | 10-2007-0055352 | | 5/2007 |
| TW | 200902704 | | 1/2009 |
| TW | 201343897 | | 11/2013 |
| WO | 2006/062245 | | 6/2006 |
| WO | 2017/145714 | | 8/2017 |

OTHER PUBLICATIONS

EP Search Report issued in EP Patent Application No. 18747502.5, dated Nov. 30, 2020.
International Search Report issued in International Patent Application No. PCT/JP2018/003013, dated Mar. 13, 2018.
English translation of IPRP issued in PCT/JP2018/003013 dated Aug. 6, 2019.

* cited by examiner

*Primary Examiner* — Taiwo Oladapo
(74) *Attorney, Agent, or Firm* — Greenblum & Bernstein, P.L.C.

(57) ABSTRACT

An aspect of the present invention relates to a refrigerating machine oil with a kinematic viscosity at 100° C. of 0.5 $mm^2/s$ or more and 1.5 $mm^2/s$ or less, a 90% distillation temperature in gas chromatography distillation of 280° C. or more and less than 360° C., and an aniline point of 70° C. or more.

16 Claims, No Drawings

REFRIGERATING MACHINE OIL

RELATED APPLICATION

This application is a national stage entry of PCT/JP2018/003013, filed Jan. 30, 2018 which claims priority from Japanese Patent Application No. 2017-201118, filed Oct. 17, 2017 and from Japanese Patent Application No. 2017-018728, filed Feb. 3, 2017, which are incorporated by reference in their entirety.

TECHNICAL FIELD

The present invention relates to a refrigerating machine oil.

BACKGROUND ART

A refrigerating machine such as a refrigerator and an air conditioner has a compressor for circulating a refrigerant in a refrigerant circulation system. The compressor is filled with a refrigerating machine oil for lubricating sliding components. Generally, with decrease in the viscosity of a refrigerating machine oil, the agitation resistance and the friction at the sliding portion can be reduced, so that the reduction in the viscosity of a refrigerating machine oil results in energy saving of a refrigerating machine. In Patent Literature 1, for example, a refrigerating machine oil specified at VG3 or more and VG8 or less is disclosed.

CITATION LIST

Patent Literature

Patent Literature 1: International Publication No. WO 2006/062245

SUMMARY OF INVENTION

Technical Problem

However, with a viscosity of the refrigerating machine oil lowered to a level equivalent to those of kerosene and gas oil, oil film retention at a sliding portion becomes difficult, so that the anti-wear property may not be maintained. Further, since a refrigerating machine oil is compatibilized with the refrigerant in a refrigerating machine, the viscosity is greatly lowered during use compared to the viscosity of the refrigerating machine oil itself. It is therefore extremely difficult to develop a refrigerating machine oil with the viscosity greatly lowered than ever (e.g., a kinematic viscosity at 100° C. of 1.5 $mm^2/s$ or less).

The present invention has been made in view of these circumstances, and it is an object thereof to provide a refrigerating machine oil excellent in antiwear property, even if its viscosity is greatly lowered.

Solution to Problem

An aspect of the present invention relates to a refrigerating machine oil with a kinematic viscosity at 100° C. of 0.5 $mm^2/s$ or more and 1.5 $mm^2/s$ or less, a 90% distillation temperature in gas chromatography distillation of 280° C. or more and less than 360° C., and an aniline point of 70° C. or more.

Another aspect of the present invention relates to a refrigerating machine oil with a kinematic viscosity at 100° C. of 0.5 $mm^2/s$ or more and 1.5 $mm^2/s$ or less, a 70% distillation temperature in gas chromatography distillation of 270° C. or more and less than 300° C., and an aniline point of 70° C. or more.

In each of the above aspects, the difference between the initial boiling point and the 95% distillation temperature in gas chromatography distillation is preferably 60° C. or more and 160° C. or less. The difference between the distillation end point and the 90% distillation temperature in gas chromatography distillation is preferably 40° C. or more and 140° C. or less. The distillation end point in gas chromatography distillation is preferably 390° C. or more and 425° C. or less.

In each of the above aspects, the flash point of the refrigerating machine oil is preferably 110° C. or higher. The % $C_P$ in n-d-M ring analysis of the refrigerating machine oil is preferably 40 or more and 60 or less. The % $C_N$ in n-d-M ring analysis of the refrigerating machine oil is preferably 40 or more and 65 or less. The ratio of the % $C_P$ to the % $C_N$ in n-d-M ring analysis of the refrigerating machine oil is preferably 0.6 or more and 1.4 or less.

Advantageous Effects of Invention

According to the present invention, a refrigerating machine oil excellent in antiwear property can be provided, even if its viscosity is greatly lowered.

DESCRIPTION OF EMBODIMENTS

Hereinafter, the present invention is described in detail.

The kinematic viscosity of a refrigerating machine oil at 100° C. is 0.5 $mm^2/s$ or more and 1.5 $mm^2/s$ or less. The kinematic viscosity of the refrigerating machine oil at 100° C. is preferably 0.6 $mm^2/s$ or more and 1.4 $mm^2/s$ or less, more preferably 0.8 $mm^2/s$ or more and 1.3 $mm^2/s$ or less, still more preferably 1.0 $mm^2/s$ or more and 1.3 $mm^2/s$ or less, from the perspective of better balance between the anti-wear property and the energy saving of a refrigerating machine. The kinematic viscosity in the present invention refers to the kinematic viscosity measured according to JIS K2283:2000.

The kinematic viscosity of the refrigerating machine oil at 40° C. may be, for example, 2.0 $mm^2/s$ or more, 2.5 $mm^2/s$ or more, or 2.8 $mm^2/s$ or more, and may be, for example, 4.5 $mm^2/s$ or less, 4.0 $mm^2/s$ or less, or 3.5 $mm^2/s$ or less.

The aniline point of the refrigerating machine oil is 70° C. or more, and, from the perspective of further higher antiwear property, preferably 73° C. or more, more preferably 76° C. or more, still more preferably 80° C. or more. With an aniline point of 70° C. or more, effectiveness of an extreme pressure agent tends to be enhanced. The aniline point of the refrigerating machine oil is preferably 100° C. or less, more preferably 95° C. or less, still more preferably 90° C. or less, from the perspective of the compatibility with an organic material such as a PET (polyethylene terephthalate) material, a sealing material, etc., used in a refrigeration unit (refrigerating machine). The aniline point in the present invention refers to a value measured according to JIS K2256:2013.

The distillation characteristics in the gas chromatography distillation of the refrigerating machine oil are preferably such that the distillation temperature at the low boiling point side is high and the distillation temperature at the high boiling point side is maintained in a proper range, from the perspectives of better balance between the lowering of viscosity and the lubricity of the refrigerating machine oil and maintaining the flash point high. It is desirable that such a refrigerating machine oil have distillation characteristics described below.

The initial boiling point (IBP) of the refrigerating machine oil may be, for example, 200° C. or more, 220° C. or more, or 230° C. or more, and may be, for example, 260° C. or less, 250° C. or less, or 240° C. or less.

The 5% distillation temperature $T_5$ of the refrigerating machine oil may be, for example, 205° C. or more, 225° C. or more, or 235° C. or more, and may be, for example, 265° C. or less, 255° C. or less, or 245° C. or less.

The 10% distillation temperature $T_{10}$ of the refrigerating machine oil may be, for example, 210° C. or more, 230° C. or more, or 235° C. or more, and may be, for example, 270° C. or less, 260° C. or less, or 250° C. or less.

The 50% distillation temperature $T_{50}$ of the refrigerating machine oil may be, for example, 230° C. or more, 250° C. or more, or 260° C. or more, and may be, for example, 300° C. or less, 280° C. or less, or 270° C. or less.

The 70% distillation temperature $T_{70}$ of the refrigerating machine oil is preferably 250° C. or more, more preferably 260° C. or more, still more preferably 270° C. or more, from the perspective of the lubricity and the high flash point. The 70% distillation temperature $T_{70}$ of the refrigerating machine oil is preferably less than 330° C., more preferably less than 300° C., still more preferably less than 295° C., particularly preferably less than 290° C., from the perspective of the lowering of viscosity.

The 90% distillation temperature $T_{90}$ of the refrigerating machine oil is preferably 280° C. or more and less than 360° C., more preferably 290° C. or more and 355° C. or less, and may be 280° C. or more and less than 350° C., 290° C. or more and 345° C. or less, 300° C. or more and 340° C. or less, or 300° C. or more and 330° C. or less, from the perspective of further higher antiwear property.

The 95% distillation temperature $T_{95}$ of the refrigerating machine oil may be, for example, 290° C. or more, 310° C. or more, or 330° C. or more, and may be, for example, 390° C. or less, 385° C. or less, 370° C. or less, 360° C. or less, or 350° C. or less.

The distillation end point EP of the refrigerating machine oil is preferably 390° C. or more, more preferably 395° C. or more, still more preferably 400° C. or more, from the perspective of the lubricity. The distillation end point EP of the refrigerating machine oil is preferably 440° C. or less, more preferably 430° C. or less, still more preferably 425° C. or less, from the perspective of the lowering of viscosity, and may be 420° C. or less, 415° C. or less, or 410° C. or less. The distillation end point EP is preferably 390° C. or more and 440° C. or less, more preferably 390° C. or more and 430° C. or less, still more preferably 390° C. or more and 425° C. or less, particularly preferably 395° C. or more and 425° C. or less, and may be 390° C. or more and 420° C. or less, 395° C. or more and 410° C. or less, or 400° C. or more and 415° C. or less.

From the perspectives of better balance between the lowering of viscosity of the refrigerating machine oil and the lubricity, and maintaining the flash point high as well, it is preferable that the distillation temperature at the low boiling point side be high and the distillation temperature at the high boiling point side be maintained in a proper range, as described above. In addition to the above, it is desirable that the distillation range be maintained in a moderately narrow range and in a not too narrow range as follows rather than being widened.

The difference between the initial boiling point IBP and the 95% distillation temperature $T_{95}$ of the refrigerating machine oil ($T_{95}$-IBP) is preferably 60° C. or more, more preferably 70° C. or more, still more preferably 80° C. or more. The difference between the initial boiling point IBP and the 95% distillation temperature $T_{95}$ of the refrigerating machine oil ($T_{95}$-IBP) is preferably 160° C. or less, more preferably 150° C. or less, still more preferably 140° C. or less, particularly preferably 130° C. or less. The difference between the initial boiling point IBP and the 95% distillation temperature $T_{95}$ of the refrigerating machine oil ($T_{95}$-IBP) is preferably 60° C. or more and 160° C. or less, more preferably 60° C. or more and 150° C. or less, preferably 70° C. or more and 150° C. or less, and may be 70° C. or more and 140° C. or less, or 80° C. or more and 130° C. or less.

The difference between the distillation end point EP and the 90% distillation temperature $T_{90}$ of the refrigerating machine oil (EP-$T_{90}$) is preferably 40° C. or more, more preferably 50° C. or more, still more preferably 55° C. or more, and may be 60° C. or more, and is preferably 140° C. or less, more preferably 130° C. or less, still more preferably 120° C. or less, from the perspective of the lubricity. The difference between the distillation end point EP and the 90% distillation temperature $T_{90}$ of the refrigerating machine oil (EP-$T_{90}$) is preferably 40° C. or more and 140° C. or less, more preferably 50° C. or more and 130° C. or less, still more preferably 55° C. or more and 120° C. or less, and may be 60° C. or more and 120° C. or less.

The difference between the 95% distillation temperature $T_{95}$ and the 90% distillation temperature $T_{90}$ of the refrigerating machine oil ($T_{95}$-$T_{90}$) is preferably 3° C. or more, more preferably 10° C. or more, still more preferably 20° C. or more, particularly preferably 25° C. or more, and may be 30° C. or more, and is preferably 80° C. or less, more preferably 70° C. or less, still more preferably 60° C. or less, from the perspective of the lubricity. The difference between the 95% distillation temperature $T_{95}$ and the 90% distillation temperature $T_{90}$ of the refrigerating machine oil ($T_{95}$-$T_{90}$) is preferably 3° C. or more and 80° C. or less, more preferably 10° C. or more and 80° C. or less, still more preferably 20° C. or more and 70° C. or less, particularly preferably 25° C. or more and 60° C. or less, and may be 30° C. or more and 60° C. or less.

In the present invention, the initial boiling point, the 5% distillation temperature, the 10% distillation temperature, the 50% distillation temperature, the 70% distillation temperature, the 90% distillation temperature, the 95% distillation temperature and the distillation end point respectively refer to the initial boiling point, the 5 (volume) % distillation temperature, the 10 (volume) % distillation temperature, the 50 (volume) % distillation temperature, the 70 (volume) % distillation temperature, the 90 (volume) % distillation temperature, the 95 (volume) % distillation temperature and the distillation end point measured according to the distillation test method by gas chromatography specified in ASTM D7213-05.

The refractive index of the refrigerating machine oil at 20° C. may be, for example, 1.440 or more, 1.445 or more, or 1.450 or more, and, for example, 1.470 or less, 1.465 or less, or 1.460 or less, from the perspective of better balance between the lowering of viscosity and the lubricity of the refrigerating machine oil, and maintaining the flash point high as well. The refractive index in the present invention refers to the refractive index measured at 20° C. according to JIS K0062:1992.

The density of the refrigerating machine oil at 15° C. may be preferably 0.86 g/cm$^3$ or less, more preferably 0.85 g/cm$^3$ or less, still more preferably 0.84 g/cm$^3$ or less, and for example, 0.81 g/cm$^3$ or more, or 0.815 g/cm$^3$ or more, from the perspectives of better balance between the lowering of viscosity and the lubricity of the refrigerating machine oil, and maintaining the flash point high as well. The density in the present invention refers to the density measured at 15° C. according to JIS K2249:2011.

The sulfur content in the refrigerating machine oil is not particularly limited, and is preferably 0.001 mass % or more, 0.02 mass % or more, or 0.3 mass % or less, from the perspectives of excellence in the stability and the compatibility with metal material, and may be 0.1 mass % or less, or 0.05 mass % or less. In the present embodiment, when, for example, 0.2 mass % or more of the following extreme pressure agent is added to the refrigerating machine oil, the sulfur content in the refrigerating machine oil may be less than 0.05 mass %, less than 0.02 mass %, less than 0.01 mass % or less than 0.005 mass %. The sulfur content in the present invention refers to the sulfur content measured by the ultraviolet fluorescence method specified in JIS K2541-6:2013.

The composition ratio of the refrigerating machine oil or the lubricating base oil contained therein obtained by ring analysis is preferably in the following range, from the perspectives of better balance between the lowering of viscosity and the lubricity of the refrigerating machine oil, and maintaining the flash point high as well.

The % $C_P$ of the refrigerating machine oil or the lubricating base oil contained therein is preferably 40 or more, more preferably 42 or more, more preferably 44 or more, and preferably 60 or less, more preferably 57 or less, still more preferably 54 is less. The % $C_P$ of the refrigerating machine oil or lubricating base oil contained therein is preferably 40 or more and 60 or less, more preferably 42 or more and 57 or less, still more preferably 44 or more and 54 or less.

The % $C_N$ of the refrigerating machine oil or the lubricating base oil contained therein is preferably 40 or more, more preferably 42 or more, still more preferably 44 or more, and preferably 65 or less, more preferably 60 or less, still more preferably 57 or less, particularly preferably 54 or less. The % $C_N$ of the refrigerating machine oil or the lubricating base oil contained therein is preferably 40 or more and 65 or less, more preferably 42 or more and 60 or less, still more preferably 44 or more and 57 or less, particularly preferably 44 or more and 54 or less.

The ratio of the % $C_P$ to the % $C_N$ of the refrigerating machine oil or the lubricating base oil contained therein (% $C_P$/% $C_N$) is preferably 0.6 or more, more preferably 0.7 or more, still more preferably 0.8 or more, and preferably 1.4 or less, more preferably 1.3 or less, still more preferably 1.2 or less. The ratio of the % $C_P$ to the % $C_N$ of the refrigerating machine oil or the lubricating base oil contained therein (% $C_P$/% $C_N$) is preferably 0.6 or more and 1.4 or less, more preferably 0.7 or more and 1.3 or less, still more preferably 0.8 or more and 1.2 or less.

The % $C_A$ of the refrigerating machine oil or the lubricating base oil contained therein may be preferably 5 or less, more preferably 3 or less, still more preferably 2 or less, and may be 0, preferably 0.5 or more, or 1 or more, from the perspectives of the lubricity and the stability.

The % $C_P$, the % $C_N$ and the % $C_A$ in the present invention respectively refer to values measured by a method (n-d-M ring analysis) according to ASTM D3238-95 (2010).

The flash point of the refrigerating machine oil is preferably 110° C. or more, more preferably 120° C. or more, particularly preferably 130° C. or more, from the perspective of safety, and preferably 155° C. or less, more preferably 145° C. or less for a low viscous oil with a kinematic viscosity at 40° C. being about 2 to 4 $mm^2/s$. The flash point in the present invention refers to the flash point measured according to KS K2265-4:2007 (Cleveland Open Cup (COC) method).

The pour point of the refrigerating machine oil may be, for example, −10° C. or less, −20° C. or less, or −50° C. or less, and may be −40° C. or more from the perspective of the refining cost. The pour point in the present invention refers to the pour point measured according to JIS K2269:1987.

The acid value of the refrigerating machine oil may be, for example, 1.0 mg KOH/g or less, or 0.1 mg KOH/g or less. The acid value in the present invention refers to the acid value measured according to MS K2501:2003.

The volume resistivity of the refrigerating machine oil may be, for example, $1.0\times10^9$ Ω·m or more, $1.0\times10^{10}$ Ω·m or more, or $1.0\times10^{11}$ Ω·m or more. The volume resistivity in the present invention refers to the volume resistivity at 25° C. measured according to JIS C2101:1999.

The moisture content in the refrigerating machine oil may be, for example, 200 ppm or less, 100 ppm or less, or 50 ppm or less, based on the total amount of the refrigerating machine oil.

The ash content of the refrigerating machine oil may be, for example, 100 ppm or less, or 50 ppm or less. The ash content in the present invention refers to the ash content measured according to MS K2272:1998.

The refrigerating machine oil in one embodiment is a refrigerating machine oil having at least characteristics such that a kinematic viscosity at 100° C. is 0.5 $mm^2/s$ or more and 1.5 $mm^2/s$ or less, a 90% distillation temperature in gas chromatography distillation is 280° C. or more and less than 360° C., and an aniline point is 70° C. or more, among the above characteristics. The refrigerating machine oil in another embodiment is a refrigerating machine oil having at least characteristics such that a kinematic viscosity at 100° C. is 0.5 $mm^2/s$ or more and 1.5 $mm^2/s$ or less, a 70% distillation temperature in gas chromatography distillation is 270° C. or more and less than 300° C., and an aniline point is 70° C. or more, among the above characteristics.

The refrigerating machine oil having the above characteristics contains, for example, a lubricating base oil and a lubricating oil additive. Examples of the lubricating base oil include mineral oils. The mineral oils can be obtained by refining lubricating oil fractions obtained from atmospheric distillation and vacuum distillation of crude oil such as paraffinic or naphthenic oil through a process such as solvent deasphalting, solvent refining, hydrorefining, hydrocracking, solvent dewaxing, hydrodewaxing, clay treatment and sulfuric acid cleaning. These refining processes may be used alone or in combination of two or more thereof. Preferably a low viscous lubricating base oil appropriately selected from those for general use in applications of solvents, diluents, metal working oils, etc., is used as the lubricating base oil from the perspective of availability.

In order to produce the refrigerating machine oil having the above characteristics, it is desirable that the characteristics of the lubricating base oil as main component (for example, 90 mass % or more) be also similar to those described above unless otherwise specified in the present specification. The preferred range for characteristics in each item of the refrigerating machine oil has been described above; however, the preferred range for characteristics in each item of the lubricating base oil contained in the refrigerating machine oil may be therefore replaced therewith.

The sulfur content of the lubricating base oil is not particularly limited, and is preferably 0.001 mass % or more, 0.02 mass % or more, or 0.3 mass % or less, from the perspective of excellence in the stability and the compatibility with metal material, and may be 0.1 mass % or less, or 0.05 mass % or less. In the present embodiment, when, for example, 0.2 mass % or more of the following extreme pressure agent is added to the refrigerating machine oil, the sulfur content in the lubricating base oil may be less than 0.05 mass %, less than 0.02 mass %, less than 0.01 mass %, or less than 0.005 mass %.

The lubricating base oil may consist of the above mineral oil, of which proportion based on the total amount of the lubricating base oil may be usually 50 mass % or more, preferably 70 mass % or more, particularly preferably 90 mass % or more, and may further contain hydrocarbon oils such as alkylbenzenes, or oxygen-containing oils such as esters in addition to the above mineral oil so long as the effect of the present invention is not markedly impaired.

The alkylbenzenes may be at least one selected from the group consisting of the following alkylbenzenes (a1) and alkylbenzenes (a2).

Alkylbenzenes (a1): alkylbenzenes having 1 to 4 alkyl groups having 1 to 19 carbon atoms, with the total number of carbon atoms in the alkyl groups being 9 to 19 (preferably, alkylbenzenes having 1 to 4 alkyl groups having 1 to 15 carbon atoms, with the total number of carbon atoms in the alkyl groups being 9 to 15).

Alkylbenzenes (a2): alkylbenzenes having 1 to 4 alkyl groups having 1 to 40 carbon atoms, with the total number of carbon atoms in the alkyl groups being 20 to 40 (preferably, alkylbenzenes having 1 to 4 alkyl groups having 1 to 30 carbon atoms, with the total number of carbon atoms in the alkyl groups being 20 to 30).

The esters may be, for example, esters of monohydric alcohols or dihydric alcohols and fatty acids. The monohydric alcohols or the dihydric alcohols may be, for example, aliphatic alcohols having 4 to 12 carbon atoms. The fatty acids may be, for example, fatty acids having 4 to 18 carbon atoms.

The kinematic viscosity of the lubricating base oil at 40° C. may be, for example, 2.0 $mm^2/s$ or more, 2.5 $mm^2/s$ or more, or 2.8 $mm^2/s$ or more, and may be, for example, 4.5 $mm^2/s$ or less, 4.0 $mm^2/s$ or less, or 3.5 $mm^2/s$ or less. The kinematic viscosity of the lubricating base oil at 100° C. may be, for example, 0.5 $mm^2/s$ or more, 0.6 $mm^2/s$ or more, 0.8 $mm^2/s$ or more, or 1.0 $mm^2/s$ or more, and may be, for example, 1.5 $mm^2/s$ or less, 1.4 $mm^2/s$ or less, or 1.3 $mm^2/s$ or less.

The content of the lubricating base oil based on the total amount of the refrigerating machine oil may be 50 mass % or more, 60 mass % or more, 70 mass % or more, 80 mass % or more, 90 mass % or more, or 95 mass % or more.

Examples of the lubricating additives include acid scavengers, antioxidants, extreme pressure agents, oiliness agents, defoaming agents, metal deactivators, anti-wear agents, viscosity index improvers, pour point depressants, and detergent-dispersants. The content of these additives may be 10 mass % or less, or 5 mass % or less, based on the total amount of the refrigerating machine oil.

The refrigerating machine oil preferably contains an extreme pressure agent among the above additives, from the perspective of more excellent antiwear property. Preferred examples of the extreme pressure agent include phosphorus-based extreme pressure agents. Examples of the phosphorus-based extreme pressure agents include phosphate esters, acidic phosphate esters, amine salts of acidic phosphate esters, chlorinated phosphate esters, phosphite esters, and phosphorothionates. The phosphate esters are preferably triphenyl phosphates (TPP) or tricresyl phosphates (TCP). The content of the phosphorus-based extreme pressure agent may be, for example, 0.2 mass % or more, and is preferably 0.5 to 5 mass %, more preferably 1 to 4 mass %, particularly preferably 1.5 to 3 mass %, based on the total amount of the refrigerating machine oil. With use of a lubricating base oil having an aniline point of 70° C. or more, the effect of the extreme pressure agent tends to be enhanced.

The refrigerating machine oil according to the present embodiment is usually mixed with a refrigerant in a refrigerating machine and present in a state of a working fluid composition for a refrigerating machine. In other words, the working fluid composition for a refrigerating machine according to the present embodiment contains the above refrigerating machine oil and a refrigerant. The content of the refrigerating machine oil in the working fluid composition for a refrigerating machine may be 1 to 500 parts by mass, or 2 to 400 parts by mass, per 100 parts by mass of the refrigerant.

Examples of the refrigerants include hydrocarbon refrigerants, saturated fluorinated hydrocarbon refrigerants, unsaturated fluorinated hydrocarbon refrigerants, fluorine-containing ether refrigerants such as perfluoro ethers, bis(trifluoromethyl)sulfide refrigerants, trifluoroiodomethane refrigerants, and natural refrigerants such as ammonia and carbon dioxide.

The hydrocarbon refrigerant is preferably a hydrocarbon having 1 to 5 carbon atoms, more preferably a hydrocarbon having 2 to 4 carbon atoms. Specific examples of the hydrocarbon include methane, ethylene, ethane, propylene, propane (R290), cyclopropane, normal butane, isobutane (R600a), cyclobutane, methyl cyclopropane, 2-methylbutane, normal pentane or a mixture of two or more thereof. Among them, the hydrocarbon refrigerant is preferably a hydrocarbon refrigerant in a gas state at 25° C. under 1 atmospheric pressure, more preferably, propane, normal butane, isobutane, 2-methylbutane, or a mixture thereof.

The saturated fluorinated hydrocarbon refrigerant is a saturated fluorinated hydrocarbon having preferably 1 to 3 carbon atoms, more preferably 1 to 2 carbon atoms. Specific examples of the saturated fluorinated hydrocarbon refrigerant include difluoromethane (R32), trifluoromethane (R23), pentafluoroethane (R125), 1,1,2,2-tetrafluoroethane (R134), 1,1,1,2-tetrafluoroethane (R134a), 1,1,1-trifluoroethane (R143a), 1,1-difluoroethane (R152a), fluoroethane (R161), 1,1,1,2,3,3,3-heptafluoropropane (R227ea), 1,1,1,2,3,3-hexafluoropropane (R236ea), 1,1,1,3,3,3-hexafluoropropane (R236fa), 1,1,1,3,3-pentafluoropropane (R245fa), and 1,1,1,3,3-pentafluorobutane (R365mfc), or a mixture of two or more thereof.

The saturated fluorinated hydrocarbon refrigerant is appropriately selected from the above depending on the application and the required performance. Examples of the saturated fluorinated hydrocarbon refrigerant include R32 alone; R23 alone; R134a alone; R125 alone; a mixture of R134a and R32 in a ratio of 60 to 80 mass %/40 to 20 mass %; a mixture of R32 and R125 in a ratio of 40 to 70 mass %/60 to 30 mass %; a mixture of R125 and R143a in a ratio of 40 to 60 mass %/60 to 40 mass %; a mixture of R134a, R32 and R125 in a ratio of 60 mass %/30 mass %/10 mass %; a mixture of R134a, R32 and R125 in a ratio of 40 to 70 mass %/15 to 35 mass %/5 to 40 mass %; and a mixture of R125, R134a and R143a in a ratio of 35 to 55 mass %/1 to 15 mass %/40 to 60 mass %. More specifically, examples of the saturated fluorinated hydrocarbon refrigerant may include a mixture of R134a and R32 in a ratio of 70/30 mass %; a mixture of R32 and R125 in a ratio of 60/40 mass %;

a mixture of R32 and R125 in a ratio of 50/50 mass % (R410A); a mixture of R32 and R125 in a ratio of 45/55 mass % (R410B); a mixture of R125 and R143a in a ratio of 50/50 mass % (R507C); a mixture of R32, R125 and R134a in a ratio of 30/10/60 mass %; a mixture of R32, R125 and R134a in a ratio of 23/25/52 mass % (R407C); a mixture of R32, R125 and R134a in a ratio of 25/15/60 mass % (R407E); and a mixture of R125, R134a and R143a in a ratio of 44/4/52 mass % (R404A).

The unsaturated fluorinated hydrocarbon (HFO) refrigerant is preferably an unsaturated fluorinated hydrocarbon having 2 to 3 carbon atoms, more preferably a fluoropropene, still more preferably a fluoropropene having 3 to 5 fluorine atoms. The unsaturated fluorinated hydrocarbon refrigerant is preferably any one of 1,2,3,3,3-pentafluoropropene(HFO-1225 ye), 1,3,3,3-tetrafluoropropene (HFO-1234ze), 2,3,3,3-tetrafluoropropene(HFO-1234yf), 1,2,3,3-tetrafluoropropene (HFO-1234ye), and 3,3,3-trifluoropropene (HFO-1243zf), or a mixture of two or more thereof. The unsaturated fluorinated hydrocarbon refrigerant is preferably one or two or more selected from HFO-1225ye, HFO-1234ze and HFO-1234yf, from the perspective of the physical properties of the refrigerant. The unsaturated fluorinated hydrocarbon refrigerant may be a fluoroethylene, and is preferably 1,1,2,3-trifluoroethylene.

The refrigerating machine oil and the working fluid composition for a refrigerating machine according to the present embodiment are suitably used in air-conditioners having a reciprocating or rotary hermetic compressor, refrigerators, open-type or hermetic auto air conditioners, dehumidifiers, water heaters, freezers, refrigerator/freezer warehouses, vending machines, showcases, refrigerating machines in chemical plants, refrigerating machines having a centrifugal compressor, and the like.

The refrigerating machine oil according to the present embodiment can be used together with the above refrigerant, and is particularly suitably used together with the hydrocarbon refrigerant from the perspectives of the low-temperature characteristics and compatibility when mixed with the refrigerant. Similarly, the working fluid composition for a refrigerating machine according to the present embodiment preferably contains a hydrocarbon refrigerant, in particular.

EXAMPLES

Hereinafter, the present invention is more specifically described with reference to Examples, though the present invention is not limited to the Examples.

The following refrigerating machine oils (test oils 1 to 4) were prepared. The characteristics of refrigerating machine oil each are shown together with a commercially available low-viscous refrigerating machine oil (test oil 5) in Table 2.

(Test Oil)

Test oil 1: a refrigerating machine oil made of a base oil obtained by mixing commercially available base oils 1, 2 and 3 shown in Table 1 (sulfur content: less than 0.005 mass %) with addition of 1.7 mass % of tricresyl phosphate and 5 ppm by mass of a defoaming agent based on the total amount of the refrigerating machine oil.

Test oil 2: a refrigerating machine oil made of a base oil obtained by mixing commercially available base oils 1, 2 and 3 shown in Table 1 (sulfur content: less than 0.005 mass %) with addition of 1.7 mass % of tricresyl phosphate and 5 ppm by mass of a defoaming agent based on the total amount of the refrigerating machine oil.

Test oil 3: a refrigerating machine oil made of a base oil obtained by mixing commercially available base oils 1, 4 and 5 shown in Table 1 (sulfur content: 0.005 mass %) with addition of 1.7 mass % of tricresyl phosphate and 5 ppm by mass of a defoaming agent based on the total amount of the refrigerating machine oil.

Test oil 4: a refrigerating machine oil made of a commercially available base oil 1 shown in Table 1 (sulfur content: less than 0.005 mass %) with addition of 1.7 mass % of tricresyl phosphate and 5 ppm by mass of a defoaming agent based on the total amount of the refrigerating machine oil.

Test oil 5: a commercially available low viscous refrigerating machine oil.

TABLE 1

| | | Base oil 1 | Base oil 2 | Base oil 3 | Base oil 4 | Base oil 5 |
|---|---|---|---|---|---|---|
| Kinematic viscosity at 100° C. | $mm^2/s$ | 1.0 | 1.3 | 2.2 | 1.2 | 2.2 |
| Acid value | mgKOH/g | <0.01 | <0.01 | <0.01 | <0.01 | <0.01 |
| Pour point | ° C. | −25 | −37.5 | <−40 | <−40 | <−40 |
| Sulfur content | mass % | <0.005 | <0.005 | <0.005 | <0.01 | <0.01 |
| n-d-M Ring analysis | % $C_A$ | 4.2 | 1.8 | 0 | 0.5 | 9.2 |
| | % $C_P$ | 59.1 | 44.9 | 60.5 | 18.4 | 32.9 |
| | % $C_N$ | 36.7 | 53.3 | 39.5 | 81.1 | 57.9 |
| | % $C_N$/% $C_P$ | 0.6 | 1.2 | 0.7 | 4.4 | 1.8 |

(Antiwear Property)

The antiwear property was evaluated according to the following procedure for each of the refrigerating machine oils. The results are shown in Table 2.

Based on ASTM D2670 "FALEX WEAR TEST", a test machine was subjected to a running-in operation at a refrigerating machine oil temperature of 60° C. under a load of 450 N for 5 minutes and an operation under a load of 890 N for 30 minutes, so that the wear amount (mg) of a test journal (pin) after the test was measured.

(Torque Test Under Poor Lubrication)

Each of the refrigerating machine oils was subjected to a torque test under poor lubrication according to the following procedure. The results are shown in Table 2.

Using the above FALEX tester, a lubricating portion was immersed once in each of the test oil baths shown in Table 2 and then the oil bath was removed to repeat an operation including rotations at 100 rpm under a load of 890 N for 30 seconds and a halt for 1 minute 10 times, so that the average torque (N-m) was measured.

TABLE 2

| | | | Test oil 1 | Test oil 2 | Test oil 3 | Test oil 4 | Test oil 5 |
|---|---|---|---|---|---|---|---|
| Kinematic viscosity at 100° C. | | $mm^2/s$ | 1.2 | 1.3 | 1.2 | 1.0 | 1.7 |
| Kinematic viscosity at 40° C. | | | 3.0 | 3.4 | 2.8 | 2.3 | 5.2 |
| Aniline point | | | 83 | 85 | 65 | 83 | 80 |
| Distillation characteristics in gas chromatography | IBP | ° C. | 233 | 230 | 213 | 233 | 235 |
| | $T_5$ | | 240 | 240 | 219 | 238 | 242 |
| | $T_{10}$ | | 243 | 245 | 224 | 241 | 248 |
| | $T_{50}$ | | 264 | 270 | 245 | 258 | 309 |
| | $T_{70}$ | | 276 | 290 | 256 | 265 | 338 |
| | $T_{90}$ | | 314 | 354 | 283 | 278 | 366 |
| | $T_{95}$ | | 347 | 380 | 375 | 284 | 374 |
| | EP | | 406 | 410 | 428 | 304 | 404 |
| | $T_{95}$-$T_{90}$ | | 33 | 26 | 92 | 7 | 8 |
| | $T_{95}$-IBP | | 114 | 150 | 162 | 52 | 139 |
| | EP-$T_{90}$ | | 92 | 56 | 145 | 26 | 38 |
| Refractive index at 20° C. | | | 1.4516 | 1.4532 | 1.469 | 1.4426 | 1.4674 |
| Density at 15° C. | | $g/cm^3$ | 0.822 | 0.825 | 0.865 | 0.801 | 0.853 |
| n-d-M Ring analysis | % $C_A$ | | 1.9 | 2.3 | 2.2 | 4.2 | 7.4 |
| | % $C_P$ | | 50.2 | 54.6 | 30.6 | 59.2 | 55.6 |
| | % $C_N$ | | 47.9 | 43.1 | 67.2 | 36.6 | 37.0 |
| | % $C_P$/% $C_N$ | | 1.0 | 1.3 | 0.5 | 1.6 | 1.5 |
| Flash point (COC) | | ° C. | 126 | 130 | 106 | 108 | 136 |
| Acid value | | mgKOH/g | <0.01 | <0.01 | <0.01 | <0.01 | <0.01 |
| Sulfur content | | mass % | <0.005 | <0.005 | 0.005 | <0.005 | 0.02 |
| Pour point | | ° C. | −30 | −32.5 | −42.5 | −25 | −32.5 |
| FALEX wear amount | | mg | 5.4 | 5.5 | 9.2 | 11 | 13.4 |
| Torque test under poor lubrication | | N-m | 0.94 | 0.93 | 1.04 | 1.1 | 0.94 |

(Low Temperature Precipitation Property During Mixing with Hydrocarbon Refrigerant)

Based on J1S K2211:2009 Annex A "Testing method for low temperature precipitation property", the low temperature precipitation temperature of the test oils 1 and 2 at a concentration of 10 mass % was measured using isobutane (R600a) as the refrigerant. The low temperature precipitation temperature at that time was −50° C. or less, so that it was confirmed that the test oils 1 and 2 can be used as refrigerating machine oil for a hydrocarbon refrigerant.

(Two-Layer Separation Temperature During Mixing with Hydrocarbon Refrigerant)

Further, based on JIS K2211:2009 Annex D "Test method for compatibility with refrigerant", the two-layer separation temperature of the test oils 1 and 2 at a concentration of 10 mass % was measured using isobutane (R600a) as the refrigerant. The two-layer separation temperature at that time was −50° C. or less, it was confirmed that the test oils 1 and 2 can be used as refrigerating machine oil for a hydrocarbon refrigerant.

The invention claimed is:

1. A refrigerating machine oil having a kinematic viscosity at 100° C. of 0.5 $mm^2/s$ or more and 1.5 $mm^2/s$ or less, a kinematic viscosity at 40° C. of 3.5 $mm^2/s$ or less, a 90% distillation temperature in gas chromatography distillation of 280° C. or more and less than 360° C., a distillation end point in gas chromatography distillation of 390° C. or more, and an aniline point of 70° C. or more, the refrigerating machine oil comprising a lubricating base oil and a phosphorous-based extreme pressure agent.

2. A refrigerating machine oil having a kinematic viscosity at 100° C. of 0.5 $mm^2/s$ or more and 1.5 $mm^2/s$ or less, a kinematic viscosity at 40° C. of 3.5 $mm^2/s$ or less, a 70% distillation temperature in gas chromatography distillation of 270° C. or more and less than 300° C., a distillation end point in gas chromatography distillation of 390° C. or more, and an aniline point of 70° C. or more, the refrigerating machine oil comprising a lubricating base oil and a phosphorous-based extreme pressure agent.

3. The refrigerating machine oil according to claim 1, wherein the refrigerating machine oil has a difference between an initial boiling point and a 95% distillation temperature in gas chromatography distillation of 60° C. or more and 160° C. or less.

4. The refrigerating machine oil according to claim 1, wherein the refrigerating machine oil has a difference between a distillation end point and a 90% distillation temperature in gas chromatography distillation of 40° C. or more and 140° C. or less.

5. The refrigerating machine oil according to claim 1, wherein the refrigerating machine oil has a distillation end point in gas chromatography distillation of 425° C. or less.

6. The refrigerating machine oil according to claim 1, wherein the refrigerating machine oil has a flash point of 110° C. or more.

7. The refrigerating machine oil according to claim 1, wherein the refrigerating machine oil has a % $C_P$ in n-d-M ring analysis of 40 or more and 60 or less.

8. The refrigerating machine oil according to claim 1, wherein the refrigerating machine oil has a % $C_N$ in n-d-M ring analysis of 40 or more and 65 or less.

9. The refrigerating machine oil according to claim 1, wherein the refrigerating machine oil has a ratio of a % $C_P$ to a % $C_N$ in n-d-M ring analysis of 0.6 or more and 1.4 or less.

10. The refrigerating machine oil according to claim 2, wherein the refrigerating machine oil has a difference between an initial boiling point and a 95% distillation temperature in gas chromatography distillation of 60° C. or more and 160° C. or less.

11. The refrigerating machine oil according to claim 2, wherein the refrigerating machine oil has a difference between a distillation end point and a 90% distillation temperature in gas chromatography distillation of 40° C. or more and 140° C. or less.

12. The refrigerating machine oil according to claim 2, wherein the refrigerating machine oil has a distillation end point in gas chromatography distillation of 425° C. or less.

13. The refrigerating machine oil according to claim 2, wherein the refrigerating machine oil has a flash point of 110° C. or more.

14. The refrigerating machine oil according to claim 2, wherein the refrigerating machine oil has a % $C_P$ in n-d-M ring analysis of 40 or more and 60 or less.

15. The refrigerating machine oil according to claim 2, wherein the refrigerating machine oil has a % $C_N$ in n-d-M ring analysis of 40 or more and 65 or less.

16. The refrigerating machine oil according to claim 2, wherein the refrigerating machine oil has a ratio of a % $C_P$ to a % $C_N$ in n-d-M ring analysis of 0.6 or more and 1.4 or less.

* * * * *